US005829967A

United States Patent [19]

Chyou

[11] Patent Number: 5,829,967

[45] Date of Patent: Nov. 3, 1998

[54] COMBUSTION CHAMBER WITH TWO-STAGE COMBUSTION

[75] Inventor: Yau-Pin Chyou, Taipei, Taiwan

[73] Assignee: Asea Brown Boveri AG, Baden, Switzerland

[21] Appl. No.: 596,768

[22] Filed: Feb. 5, 1996

[30] Foreign Application Priority Data

Mar. 24, 1995 [DE] Germany ..... 195 10 744.6

[51] Int. Cl.[6] ..... F23D 14/46

[52] U.S. Cl. ..... 431/350; 431/182; 431/185; 431/285; 431/353

[58] Field of Search ..... 431/350–354, 431/285, 173, 284, 8, 10, 187, 278; 60/464, 743, 39.21, 39.52, 723

[56] References Cited

U.S. PATENT DOCUMENTS

| | | | |
|---|---|---|---|
| 5,433,596 | 7/1995 | Dobbeling et al. | 431/350 |
| 5,513,982 | 5/1996 | Althaus et al. | 431/354 |
| 5,558,515 | 9/1996 | Althaus et al. | 431/353 |

FOREIGN PATENT DOCUMENTS

| | | |
|---|---|---|
| 0321809B1 | 6/1989 | European Pat. Off. . |
| 0471985A1 | 2/1992 | European Pat. Off. . |
| 0576697A1 | 1/1994 | European Pat. Off. . |
| 0602396A1 | 6/1994 | European Pat. Off. . |
| 0619133A1 | 10/1994 | European Pat. Off. . |
| 0619134A1 | 10/1994 | European Pat. Off. . |
| 0620362A1 | 10/1994 | European Pat. Off. . |
| 0626543A1 | 11/1994 | European Pat. Off. . |
| 2629761 | 1/1978 | Germany . |
| 2826699 | 1/1979 | Germany . |

*Primary Examiner*—James C. Yeung
*Attorney, Agent, or Firm*—Burns, Doane, Swecker & Mathis, L.L.P.

[57] ABSTRACT

A combustion chamber with two-stage combustion has primary burners (110) of the premix type of construction, in which the fuel injected via nozzles (117) is intensively mixed with the combustion air inside a premix space (115) prior to ignition. The primary burners are of flame-stabilizing design, i.e. they are designed without a mechanical flame retention baffle. They are provided with tangential inflow of the combustion air into the premix space (115). Arranged downstream of a precombustion chamber (61) are secondary burners (150) which are designed as premix burners which do not operate by themselves.

12 Claims, 7 Drawing Sheets

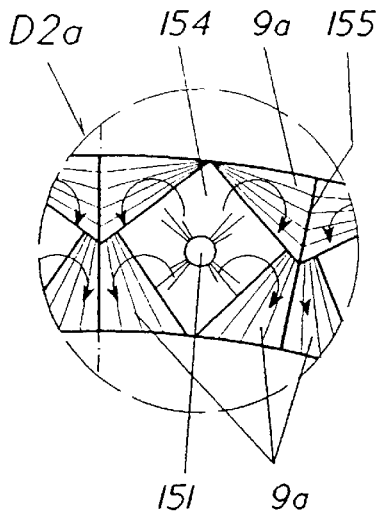
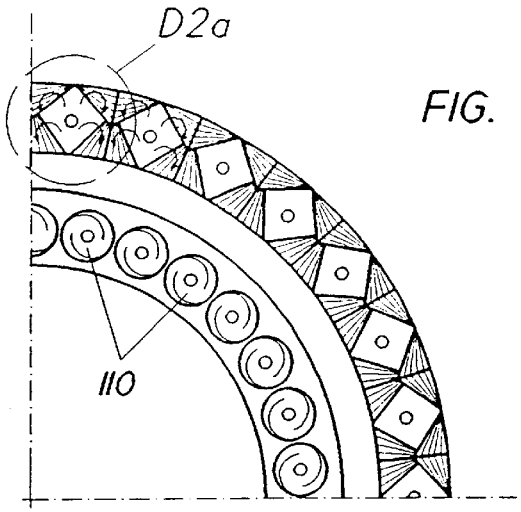
FIG. 2A
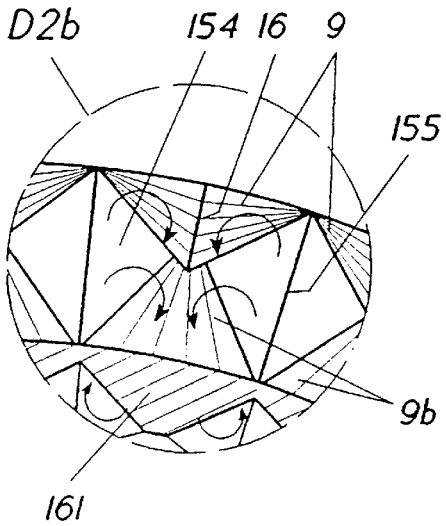
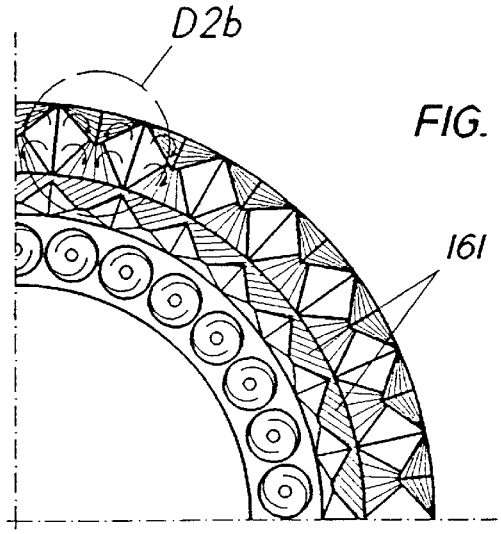
FIG. 2B
FIG. 3A
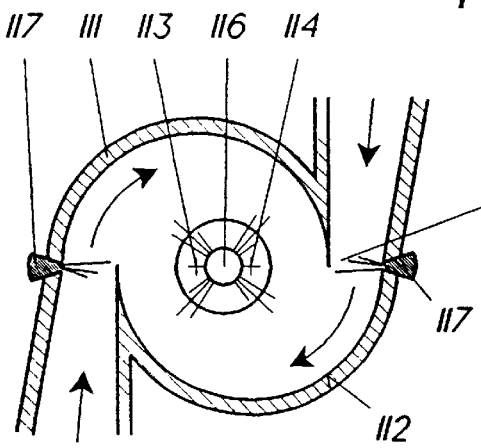
FIG. 3B
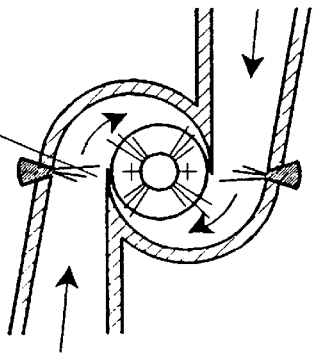

COMBUSTION CHAMBER WITH TWO-STAGE COMBUSTION

BACKGROUND OF THE INVENTION

1. Field of the Invention

The invention relates to a combustion chamber with two-stage combustion, having at least one primary burner of the premix type of construction, in which the fuel injected via nozzles is intensively mixed with the combustion air inside a premix space prior to ignition, and having at least one secondary burner which is arranged downstream of a precombustion chamber.

2. Discussion of Background

The combustion having the highest possible excess-air coefficient, because the flame is actually still burning and furthermore because not too much CO develops, not only reduces the $NO_x$ pollutant quantity but in addition also keeps other pollutants at a low level, namely CO and unburnt hydrocarbons. This allows a higher excess-air coefficient to be selected, in which case larger quantities of CO certainly develop to begin with, but these quantities of CO can react further to form $CO_2$, so that finally the CO emissions remain low. On the other hand, however, only a little additional NO forms on account of the large amount of excess air. Since a larger number of burners are as a rule arranged in a combustion chamber for gas turbines for example, in each case only so many elements are operated with fuel during the load control that the optimum excess-air coefficient is obtained for the respective operating phase (start, part load, full load).

In order to achieve reliable ignition of the mixture in the downstream combustion chamber and satisfactory burn-out, intimate mixing of the fuel with the air is necessary. Good intermixing also helps to avoid so-called hot spots in the combustion chamber, which lead, inter alia, to the formation of unwanted $NO_x$. For this reason, two-stage combustion chambers having premix burners of the type mentioned at the beginning in the primary stage are being increasingly used.

This is because in single-stage combustion chambers having premix burners the limit of flame stability is nearly reached at least in the operating states in which only some of the burners are operated with fuel or during which a reduced fuel quantity is admitted to the individual burners. Indeed, under typical gas-turbine conditions, the extinction limit will already be reached at an excess-air coefficient of about 2.0 on account of the very lean mixture and the resulting low flame temperature.

This fact leads to a relatively complicated mode of operation of the combustion chamber with correspondingly complicated control. Assisting the burner with a small diffusion flame is seen as another possibility of extending the operating range of premix burners. This pilot flame receives pure fuel or at least poorly premixed fuel, which on the one hand certainly leads to a stable flame but on the other hand results in the high $NO_x$ emissions typical of diffusion combustion.

In both oil operation at very high pressure and gas operation with gases containing a considerable amount of hydrogen, it is possible in premix burners for the ignition-delay times to become so short that flame-retaining burners can no longer be used as so-called low-$NO_x$ burners.

The intermixing of fuel with a combustion-air flow in a premix duct takes place as a rule by radial injection of the fuel into the duct by means of cross-jet mixers. However, the impulse of the fuel is so low that virtually complete intermixing is effected only after a distance of about 100 duct heights. Venturi mixers are also used. The injection of fuel via cascade arrangements is also known. Finally, the injection in front of special swirl bodies is also used.

The devices working on the basis of cross jets or laminar flows either result in very long mixing distances or require high injection impulses. During premixing under high pressure and sub-stoichiometric mixing ratios there is the risk of flashback of the flame or even of self-ignition of the mixture. Flow separations and wake zones in the premix tube, thick boundary layers at the walls or possibly extreme velocity profiles over the cross section through which flow occurs may be the cause of self-ignition in the tube or may form paths via which the flame can flash back from the downstream combustion zone into the premix tube. Accordingly, the greatest attention must be paid to the geometry of the premix section.

The abovementioned injection of the fuel via conventional means, such as, for example, cross-jet mixers, is difficult, since the fuel itself has an inadequate impulse in order to achieve the requisite large-scale distribution and the fine-scale mixing.

SUMMARY OF THE INVENTION

Accordingly, one object of the invention, in attempting to avoid all these disadvantages, is to provide low-emission secondary combustion.

This is achieved according to the invention in that the primary burner is a flame-stabilizing premix burner without a mechanical flame retention baffle, having an at least approximately tangential inflow of the combustion air into the premix space, and in that the secondary burner is a premix burner which does not operate by itself.

Such flame-retaining premix burners may, for example, be the burners of the so-called double-cone type of construction, as disclosed by U.S. Pat. No. 4,932,861 to Keller et al. and described later with reference to FIGS. 1 to 3B. The fuel, gas in this case, is injected in the tangentially directed inlet gaps via a row of injector nozzles into the flow of combustion air coming from the compressor. As a rule, the injector nozzles are uniformly distributed over the entire gap.

The advantage of the invention, in such a lean/lean mode of operation of the combustion chamber, may be seen in particular in secondary combustion which is neutral in terms of $NO_x$.

Owing to the fact that the burners remain operable on a very lean mixture, the control can also be simplified in as much as, during loading and relief of the combustion chamber, air-coefficient ranges can be crossed, which as a rule could not be covered by the previous premix combustion, without extinction of the flame having to be avoided with separate means.

In order to achieve the necessary intimate mixing, a gaseous and/or liquid fuel is injected into the duct of the secondary burner into the combustion air, the combustion air being directed via vortex generators, of which a plurality are arranged next to one another over the periphery of the duct through which flow occurs.

These vortex generators include a top surface and two side surfaces, the side surfaces being attached to a duct wall and define as a sweepback angle $\alpha$ with one another, and the longitudinally directed edges of the top surface are flush with the longitudinally directed edges of the side surfaces projecting into the flow duct and run at a setting angle $\theta$ to the duct wall.

The novel static mixer represented by the 3-dimensional vortex generators enables exceptionally short mixing distances with at the same time low pressure loss to be achieved in the secondary burners. By the generation of longitudinal vortices without a recirculation zone, rough intermixing of the two flows is already effected after a complete vortex rotation, while fine mixing as a result of turbulent flow and molecular diffusion processes is obtained after a distance which corresponds to a few duct heights.

This type of mixing is especially suitable in order to intermix the fuel with the combustion air at a relatively low supply pressure with considerable dilution. A low supply pressure of the fuel is of advantage in particular during the use of medium- and low-calorific fuel gases. In this case a substantial portion of the energy required for the mixing is drawn from the flow energy of the fluid having the greater volumetric flow, namely the combustion air.

The advantage of such vortex generators may be seen in their special simplicity. From the production point of view, the element consisting of three walls around which flow occurs is completely problem-free. The top surface may be joined together with the two side surfaces in many different ways. The fixing of the element to plane or curved duct walls may also be effected by simple welds in the case of weldable materials. From the fluidic aspect, the element has a very low pressure loss when flow occurs around it and it generates vortices without a wake zone. Finally, having a hollow inner space, the element can be cooled in a variety of different ways and with diverse means.

It is appropriate to select the ratio of height h of the connecting edge of the two side surfaces to the duct height H in such a way that the vortex produced fills the full duct height or the full height of the duct part allocated to the vortex generator directly downstream of the vortex generator If the symmetry axis of the vortex generator parallel to the duct axis, and the connecting edge of the two side surfaces forms the downstream edge of the vortex generator, the edge of the top surface running transversely to the duct through which flow occurs is the edge acted upon first by the duct flow. In that case, identical vortices, but working in opposite direction, are produced at a vortex generator. There is a flow pattern which is neutral in terms of swirl and in which the direction of rotation of the two vortices in the region of the connecting edge is rising.

Further advantages of the invention, in particular in connection with the arrangement of the vortex generators and the introduction of the fuel, follow.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 2A shows a partial cross section through the combustion chamber along line 2—2 in FIG. 1;

FIG. 2B shows a partial cross section through an arrangement variant of the vortex generators in the secondary burners;

FIG. 3A shows a cross section through a premix burner of the double-cone type of construction in the region of its outlet;

FIG. 3B shows a cross section through a premix burner of the double-cone type of construction in the region of the cone tip;

Only the elements essential for understanding the invention are shown. Not shown, for example, is the complete combustion chamber and its allocation to a plant. The direction of flow of the working media is designated by arrows. Elements not essential to the invention, such as casings, fastenings, conduit leadthroughs, the provision of fuel, the control equipment and the like, have been omitted.

DESCRIPTION OF THE PREFERRED EMBODIMENTS

Figure 1:
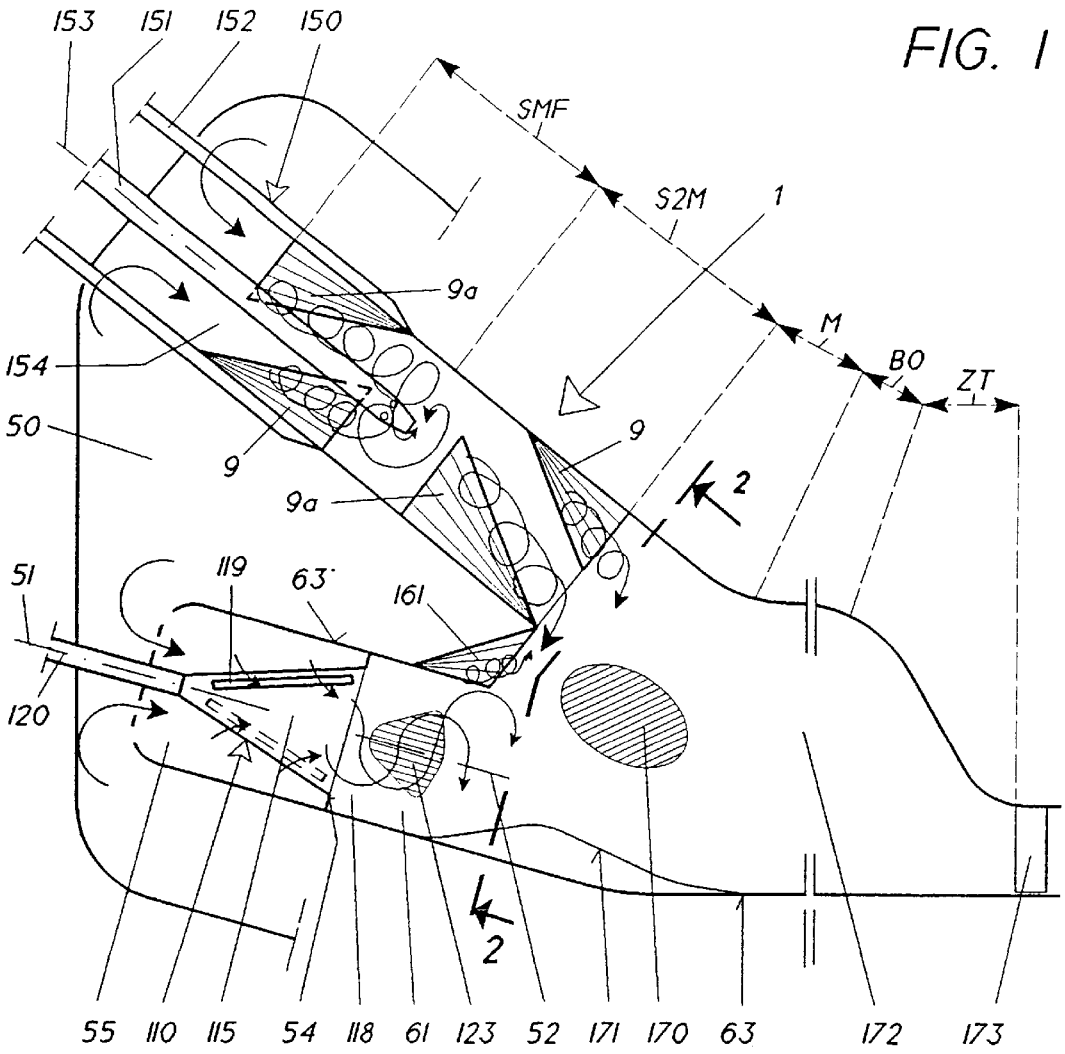
FIG. 1 shows a partial longitudinal section of a combustion chamber.

Referring now to the drawings, wherein like reference numerals designate identical or corresponding parts throughout the several views, an encased plenum is designated by 50 in FIG. 1, which as a rule receives the combustion air delivered by a compressor (not shown) and feeds it to an annular combustion chamber 1. This combustion chamber is of two-stage design and essentially comprises a precombustion chamber 61 and a secondary combustion chamber 172 situated downstream, both of which are encased by a combustion-chamber wall 63, 63'.

An annular dome 55 is mounted on the precombustion chamber 61, which is located at the head end of the combustion chamber 1. The combustion space of precombustion chamber is bounded by a front plate 54. A burner 110 is arranged in this dome in such a way that the burner outlet is at least approximately flush with the front plate 54. The longitudinal axis 51 of the primary burner 110 is aligned with the longitudinal axis 52 of the precombustion chamber 61. A plurality of such burners 110, here 30, are arranged next to one another in a distributed manner over the periphery on the annular front plate 54 (FIGS. 2A, 2B). Via the dome wall perforated at its outer end, the combustion air flows out of the plenum 50 into the dome interior and is admitted to the burners. The fuel is fed to the burner via a fuel lance 120 which passes through the plenum and dome wall.

In the plane in which the precombustion chamber 61 merges into the secondary combustion chamber 172, a number of secondary burners 150 feed the secondary combustion chamber. The secondary burners 150 are likewise premix burners. Their longitudinal axis 153 runs at an angle of, for example, about 30° to the longitudinal axis of the precombustion chamber 61. In the present example, the cross sections of the primary burners 110 and secondary burners 150 through which flow occurs are in each case dimensioned for about half the total volumetric flow to be processed.

A gaseous and/or liquid fuel is injected into the duct 154 of the secondary burners 150 into the combustion air. The combustion air flows by means (not shown) into the duct 154 from the plenum 50. The combustion air flows over a plurality of vortex generators 9, 9*a*, arranged next to one another over the periphery in two duct planes.

In the annular arrangement of the primary burners 110 and secondary burners 150 shown, the secondary burners 150 are arranged radially outward of the primary burners. A compact combustion chamber is created by this radial staggering.

At the outlet of the precombustion chamber 61 in the region where the secondary burners 150 connect to the secondary combustion chamber, vortex-generating troughs 161 are provided on the combustion-chamber wall 63' of the precombustion chamber. The transition of the precombustion chamber 61 to the secondary combustion chamber 172 is provided with a constriction 171 at the combustion-chamber wall 63 opposite the point where the secondary burners 150 lead into the secondary combustion chamber.

The point where the secondary burners connect to the secondary combustion chamber 172 is selected in such a way that complete burn-out of the mixture in the precombustion chamber 61 has still not taken place.

As apparent from FIGS. 2A and 2B to be described later, the same number of primary burners 110 and secondary numbers 150 (here about 30 of each) are arranged over the periphery. In FIG. 2A the respective axes are offset from one another by half a pitch in the peripheral direction. In FIG. 2B the axes of the primary burners 110 and secondary burners 150 lie on the same radial line. It will be understood that the number referred to and the arrangements shown are not compulsory.

The complete burn-out of the mixture is effected in the secondary combustion chamber 172. The hot flue gases then pass via a transition zone ZT, in which they are accelerated and as a rule mixed with cooling air, to the turbine inlet 173.

Concerning the primary burners

Each of the premix burners 110 schematically shown in FIGS. 1, 3A and 3B is a so-called double-cone burner as already mentioned above and as disclosed, for example, by U.S. Pat. No. 4,932,861 to Keller et al. It essentially comprises two hollow, conical sectional bodies 111, 112 which are nested one inside the and define in the direction of flow a conical premix space 115. In this arrangement, the respective center axes 113, 114 of the two sectional bodies are mutually offset. The adjacent walls of the two sectional bodies form longitudinally extending slots 119, for the tangentially directed flow of combustion air, which in this way passes into the burner interior, that is, into the premix space 115. A first central fuel nozzle 116 for liquid fuel is disposed in the premix space 115. The fuel is injected into the hollow cone at an acute angle. The resulting conical fuel profile is enclosed by the combustion air flowing in tangentially. The concentration of the fuel is continuously reduced in the axial direction as a result of the mixing with the combustion air. In the example, the fuel is likewise operated with gaseous fuel. To this end, gas-inflow openings 117 distributed in the longitudinal direction in the walls of the two sectional bodies are provided in the region of the tangential slots 119. In gas operation, therefore, the mixture formation with the combustion air already starts in the zone of the inlet slots 119. It will be understood that in this way a mixed operation with both types of fuel is also possible.

At the burner outlet 118 of the burner 110, as homogeneous a fuel concentration as possible appears over the annular cross section to which the fuel is admitted. A defined calotte-shaped recirculation zone 123 develops at the burner outlet, at the tip of which recirculation zone 123 the ignition is effected. The flame itself is stabilized by the recirculation zone in front of the burner without requiring a mechanical flame retention baffle.

Concerning the secondary burners

According to the invention, the secondary burner 150 is now to be a premix burner which does not operate by itself. By this it is meant that permanent ignition must be present for combustion of the secondary burner mixture. This permanent ignition takes place in the present case via the flame at the outlet of the precombustion chamber 61. Only the primary burners are operated in a mode of operation with low partial loads. The main flow of the secondary burners is then utilized as diluent air.

Concerning the vortex generators

Before the installation of the mixing device in the secondary burners 150 is dealt with, the vortex generator essential for the mixing action will first be described.

Figure 4:
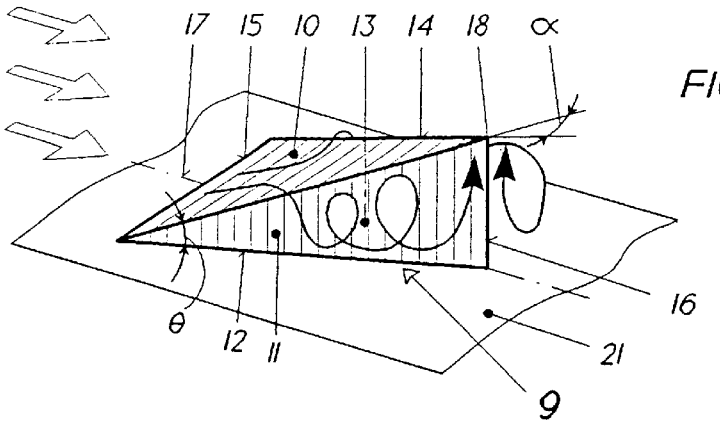
FIG. 4 shows a perspective representation of a vortex generator.
Figure 5:
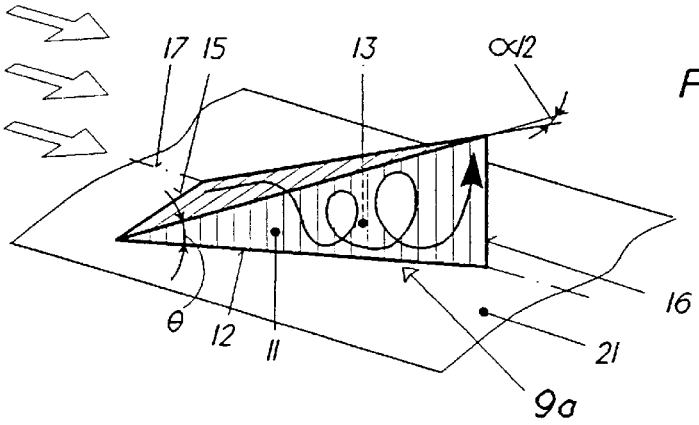
FIG. 5 shows an embodiment variant of the vortex generator.
Figure 6:
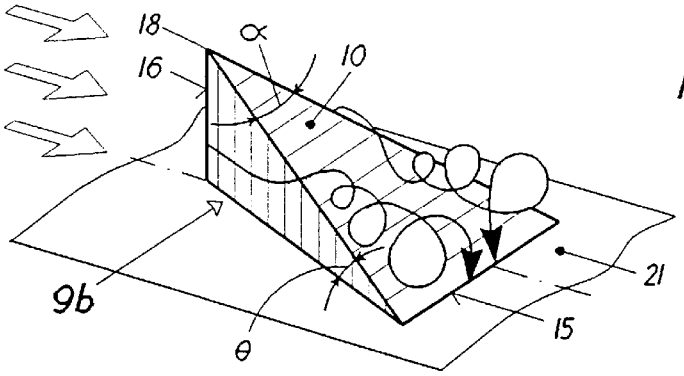
FIG. 6 shows an arrangement variant of the vortex generator according to FIG. 4.

The actual duct through which a main flow symbolized by a large arrow passes is not shown in FIGS. 4, 5 and 6. According to these figures, a vortex generator essentially comprises three triangular surfaces around which flow occurs. These are a top surface 10 and two side surfaces 11 and 13. In their longitudinal extent, these surfaces are oriented at certain angles in the direction of flow.

The side walls of the vortex generators, which consist of right-angled triangles, are fixed, preferably gastight, with one side edge mounted to a duct wall 21. The side walls are joined at the short edges and are orientated at a sweepback angle $\alpha$. The joined short edges define a sharp connecting edge 16 which is perpendicular to every duct wall 21 on which the side surfaces are mounted. The two side surfaces 11, 13 enclosing the sweepback angle $\alpha$ are symmetrical in form, size and orientation in FIG. 4 and they are arranged on both sides of a symmetry axis 17. This symmetry axis 17 is parallel to the duct axis.

The top surface 10 has a narrow edge 15 running transversely to the duct in contact with the same duct wall 21 as the side walls 11, 13. The longitudinally directed edges 12, 14 of the top surface 10 are joined longitudinally directed edges of the side surfaces projecting into the flow duct. The top surface is oriented at a setting angle $\theta$ to the duct wall 21. The longitudinal edges 12, 14 form a point 18 together with the connecting edge 16.

Of course, the vortex generator may also be provided with a base surface with which it is fastened to the duct wall 21 in a suitable manner. However, such a base surface is in no way connected with the mode of operation of the element.

In FIG. 4, the connecting edge 16 of the two side surfaces 11, 13 forms the downstream edge of the vortex generator 9. The edge 15 of the top surface 10 running transversely to the duct through which flow occurs is therefore the edge acted upon first by the duct flow.

Figure 7:
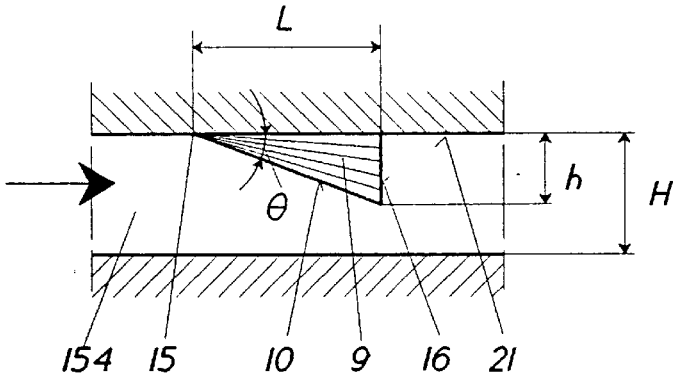
FIG. 7 shows a vortex generator in a duct.

The mode of operation of the vortex generator is as follows: when flow occurs around the edges 12 and 14, the main flow is converted into a pair of oppositely directed vortices. The straight vortex axes lie in the axis of the main flow. The swirl number and the location of the vortex breakdown, provided the latter is desired at all, are determined by corresponding selection of the setting angle θ and the sweepback angle α. The vortex intensity and the swirl number increase as the angles increase, and the location of the vortex breakdown shifts upstream right into the region of the vortex generator itself. Depending on the use, these two angles θ and α are predetermined by design considerations and by the process itself. Then only the length L of the element as well as the height h of the connecting edge 16 need to be adapted (FIG. 7).

FIG. 5 shows a so-called "half" vortex generator 9*a* on the basis of a vortex generator according to FIG. 4. Here, only one of the two side surfaces, namely the surface 11, is provided with the sweepback angle α/2. The other side surface 13 is straight and is orientated in the direction of flow. In contrast to the symmetrical vortex generator, here a vortex is only produced on the swept-back side.

Accordingly, there is no vortex-neutral field downstream of this vortex generator 9*a*; on the contrary, a swirl is imposed on the flow.

In contrast to FIG. 4, in FIG. 6 the sharp connecting edge 16 of the vortex generator 9*b* is that point which is acted upon first by the duct flow. The element is turned through 180°. As can be recognized from the representation, the two oppositely directed vortices have changed their direction of rotation.

According to FIG. 7 the vortex generators 9 are installed in a duct 154. As a rule, the height h of the connecting edge 16 will be coordinated with the duct height H—or the height of the duct part to which the vortex generator is allocated—in such a way that the vortex produced already achieves such a size directly downstream of the vortex generator that the full duct height H is filled by it. This leads to a uniform velocity distribution in the cross section acted upon. A further criterion which can bring an influence to bear on the ratio h/H to be selected is the pressure drop which occurs when the flow passes around the vortex generator. It will be understood that the pressure-loss factor also increases at a greater ratio of h/H.

Concerning the vortex generator arrangement

In the example according to FIG. 2A and its detail D2A, four half vortex generators 9*a* are provided at each of the 30 secondary burners in the outlet region. In this arrangement, the respective walls 13 (FIG. 5) which are not swept back adjoin the radial burner boundary walls 155. The resulting flow field within the annular segment is designated by arrows. It can be recognized that the overall flow is directed radially inward, specifically on the outside along the boundary walls 155.

In the example according to FIG. 2B and its detail D2B, two vortex generators 9 and 9*b* respectively are provided at each of the 30 secondary burners in the outlet region. They are distributed without a gap over the periphery of the corresponding annular segment. The vortex generators could of course also be arranged in a row in the peripheral direction at their respective wall segments in such a way that intermediate spaces are left open between boundary wall and the side walls. The vortex to be produced is ultimately decisive here.

It can be recognized from detail D2B and FIG. 1 that the radially outer vortex generators 9 are arranged according to FIG. 4 such that their inlet edges 15 are accordingly acted upon first by the flow. On the other hand, the radially inner vortex generators 9*b* are orientated according to FIG. 6, i.e. the connecting edges 16 are acted upon here first by the flow. The resulting flow field within the annular segment is again designated by arrows. It can be recognized that the overall flow is likewise directed radially inward, however not on the outside along the boundary walls 155, but in the segment center.

These various arrangements of the vortex generators and the possibility of offsetting the primary burners in the peripheral direction enables optimum mixing conditions to be created when the two flows meet.

The vortex generators are therefore mainly used for mixing two flows. The main flow in the form of combustion air attacks the transversely directed inlet edges 15 and the connecting edges 16 respectively in the arrow direction. The secondary flow in the form of a gaseous and/or liquid fuel has as a rule a substantially smaller mass flow than the main flow provided the fuels are not low-calorific fuels such as, for example, blast furnace gas. In the present case it is introduced upstream of the outlet-side vortex generators 9 and 9*a* into the main flow.

At this moment the main flow already has a vortex motion, since according to FIG. 1 a vortex-generator arrangement is already provided upstream of the central fuel lance 151. In the same plane, "half" vortex generators 9*a* are staggered here radially on the outside and inside in such a way that the vortices are now directed in the segment center with the same direction of rotation against those of the outlet-side arrangement.

It will be understood that the number of axially staggered vortex generators and thus the length of the secondary burners depends on the degree of the desired mixing quality. At least the outlet-side vortex generators, apart from performing the mixing task, should also perform the following functions:

deflect the flow radially inward;

accelerate the flow like a venturi in order to avoid a flashback of the flame. This result is achieved by the cross section through which flow occurs being blocked to a certain extent by the vortex generators;

vortex breakdown for the aerodynamic stabilization of the flame is advantageous downstream of the secondary burners.

Concerning the fuel feed to the secondary burners

According to FIG. 1, the fuel is injected at the secondary burners 150 via one central fuel lance 151 each. A cross-jet injection of the fuel is shown, the fuel impulse having to be about twice that of the main flow. Longitudinal injection in the direction of flow could just as easily be provided. In this case, the injection impulse corresponds approximately to that of the main-flow impulse.

The injected fuel is entrained by the vortices and mixed with the main flow. It follows the helical progression of the vortices and is finely divided in a uniform manner in the chamber downstream of the vortices. In the case of the radial injection, mentioned at the beginning, of fuel into a non-turbulent flow, the risk of jets impinging on the opposite wall and the formation of so-called hot spots is thereby reduced.

Since the main mixing process takes place in the vortices and is largely insensitive to the injection impulse of the secondary flow, the fuel injection can be kept flexible and can be adapted to other boundary conditions. Thus the same injection impulse can be maintained over the entire load range. Since the mixing is determined by the geometry of the vortex generators and not by the machine load, in the example the gas-turbine output, the burner configured in this way also works in an optimum manner under partial-load conditions. The combustion process is optimized by adaptation of the ignition-delay time of the fuel and the mixing time of the vortices, which ensures that emissions are minimized.

Provided a gaseous fuel is to be burnt, the fuel may also be fed into the duct 154 in another way. According to FIG. 1 the possibility of introducing the fuel directly in the region of the vortex generators via gas-feed ducts 152 presents itself.

FIGS. 8 to 14 show such possible forms of the introduction of the fuel into the combustion air with regard to the secondary burners. These variants can be combined with one another and with central fuel injection in a variety of ways.

Figure 8:
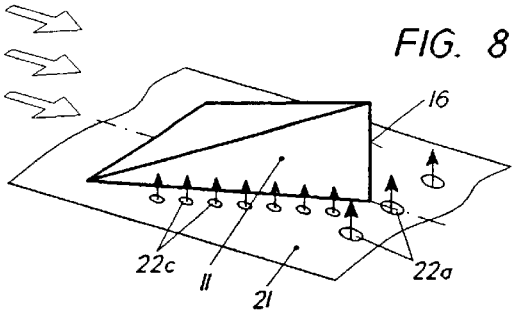
FIGS. 8 to 14 show variants of the fuel feed.

According to FIG. 8, the fuel, in addition to being injected via wall bores 22*a* downstream of the vortex generators, is injected via wall bores 22*c* which are located directly next to the side walls 11, 13 and in their longitudinal extent in the same wall 21 on which the vortex generators are arranged. The introduction of the fuel through the wall bores 22*c* gives the vortices produced an additional impulse, which prolongs the life of the vortex generator.

Figure 9:
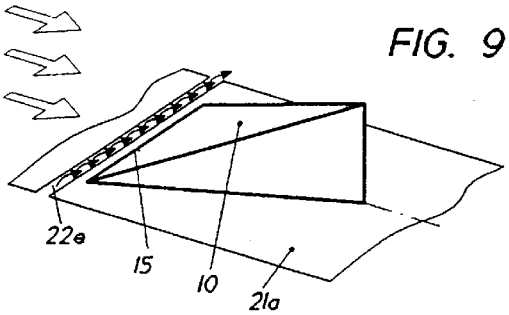
Figure 10:
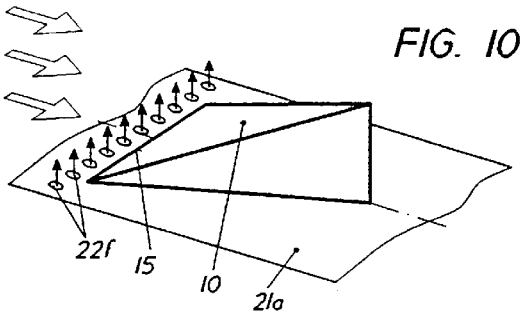

According to FIGS. 9 and 10, the fuel is injected on one side via a slot 22*e* or via wall bores 22*f*, which are located directly in front of the edge 15 of the top surface 10 running transversely to the duct through which flow occurs and in their longitudinal extent in the same wall 21 on which the vortex generators are arranged. The geometry of the wall bores 22*f* or of the slot 22*e* is selected in such a way that the fuel is injected at a certain injection angle into the main flow and flows around the following vortex generator as a protective film against the hot main flow.

In the examples described below, the secondary flow is first of all directed via means (not shown) through the duct wall 21 into the hollow interior of the vortex generator. An internal cooling means for the vortex generators is thereby created.

Figure 11:
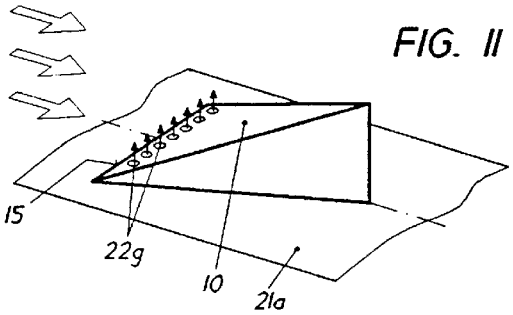

According to FIG. 11, the fuel is injected via wall bores 22*g* which are located inside the top surface 10 directly behind the edge 15, running transversely to the duct through which flow occurs, and in its longitudinal extent. The cooling of the vortex generator is effected here externally rather than internally. The issuing secondary flow, when flowing around the top surface 10, forms a protective layer screening the latter from the hot main flow.

Figure 12:
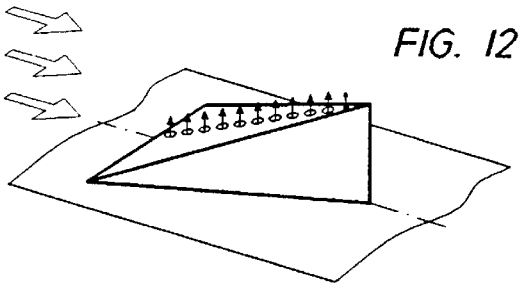

According to FIG. 12, the fuel is injected via wall bores 22*h* which are arranged staggered inside the top surface 10 along the symmetry line 17. With this variant, the duct walls are protected especially effectively from the hot main flow, since the fuel is introduced first of all at the outer periphery of the vortices.

Figure 13:
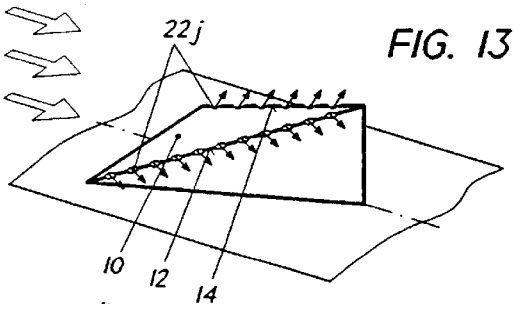

According to FIG. 13, the fuel is injected via wall bores 22*j* which are located in the longitudinally directed edges 12, 14 of the top surface 10. This solution guarantees effective cooling of the vortex generators, since the fuel issues at its extremities and thus passes completely around the inner walls of the element. The secondary flow is fed here directly into the developing vortex, which leads to defined flow relationships.

Figure 14:
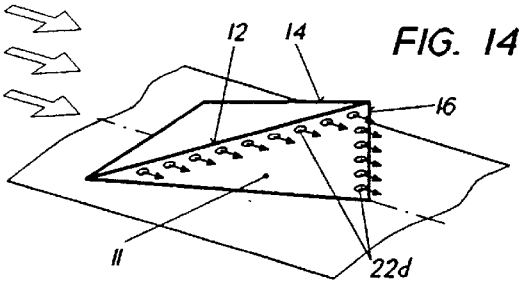

In FIG. 14, the fuel is injected via wall bores 22*d* which are located in the side surfaces 11 and 13, on the one hand in the region of the longitudinal edges 12 and 14, and on the other hand in the region of the connecting edge 16. This variant has a similar action to that from the bores 22*a* in FIG. 8 and from the bores 22*j* in FIG. 13.

Figure 15:
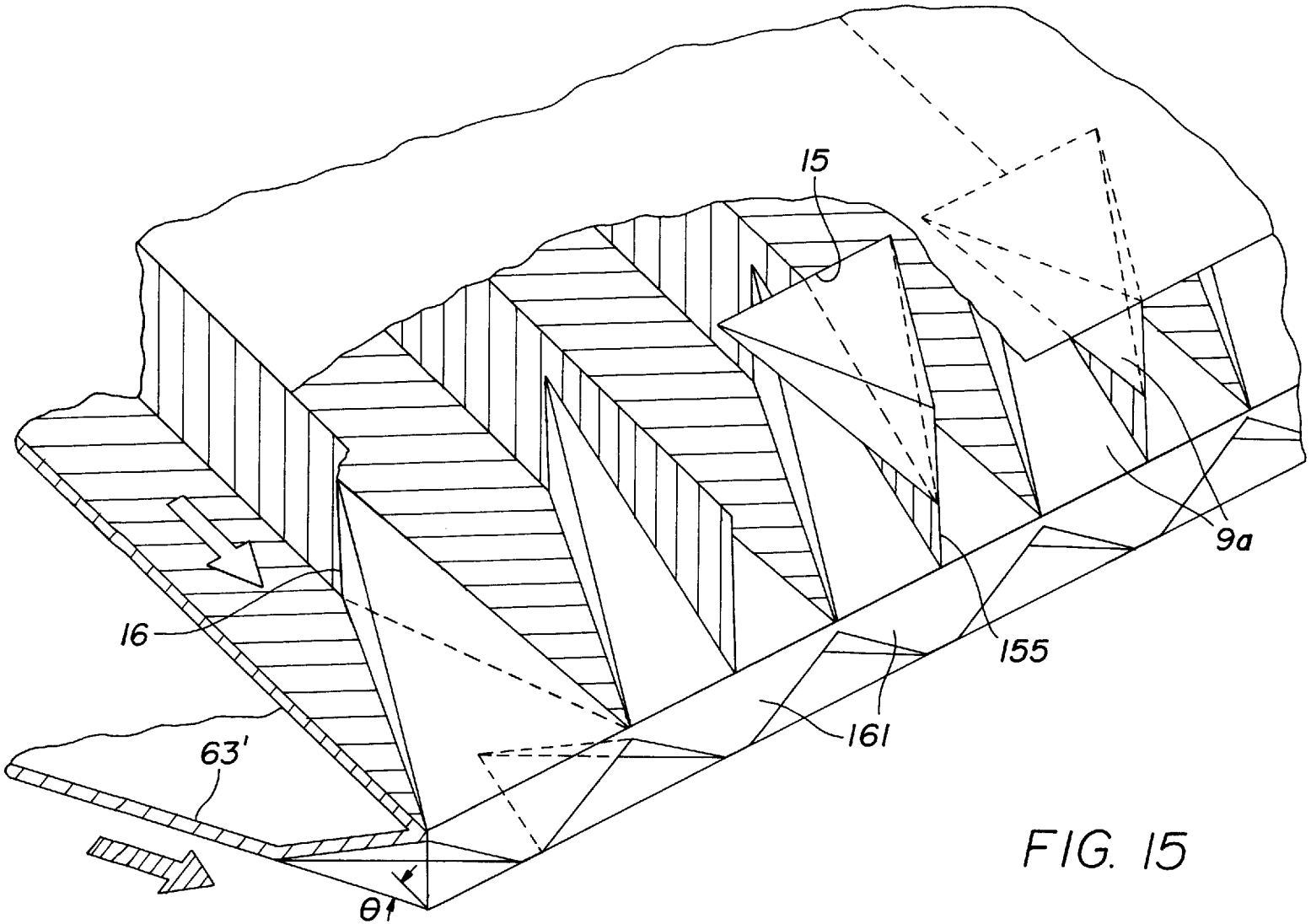
FIG. 15 shows a perspective partial view of the outlet of the secondary burners.

FIG. 15 shows a perspective partial view of the conjunction of the secondary burners and the precombustion chamber. The vortex generators provided here in the outlet region of the secondary burners correspond to those according to FIG. 2A. The flow against the radially inner "half" vortex generators 9*a* shown acts first against the connecting edge 16, which is here located in the same radial line as the segment boundary wall 155; the flow against the radially outer "half" vortex generators 9*a* acts first against the edge 15 running in the peripheral direction.

As already mentioned above, at the outlet of the precombustion chamber 61 in the region where the secondary burners 150 lead into the secondary combustion chamber, vortex-generating wedges 161 are provided on the combustion-chamber wall 63' of the precombustion chamber, which wedges 161 are of similar construction to the vortex generators described hitherto. Unlike the latter, the two side surfaces and the top surface do not form an actual point here. As FIG. 1 shows, the radially outer flow of the combustion chamber 61 is swirled radially outward by these stepped wedges and strikes the mixture, flowing radially inward, from the secondary burners.

To compensate for this partial flow deflected radially outward, the transition of the precombustion chamber 61 to the secondary combustion chamber 62 is provided with a constriction 171 at the combustion-chamber wall 63 opposite the wedges 161 in order not to disturb the area ratios.

Figure 16:
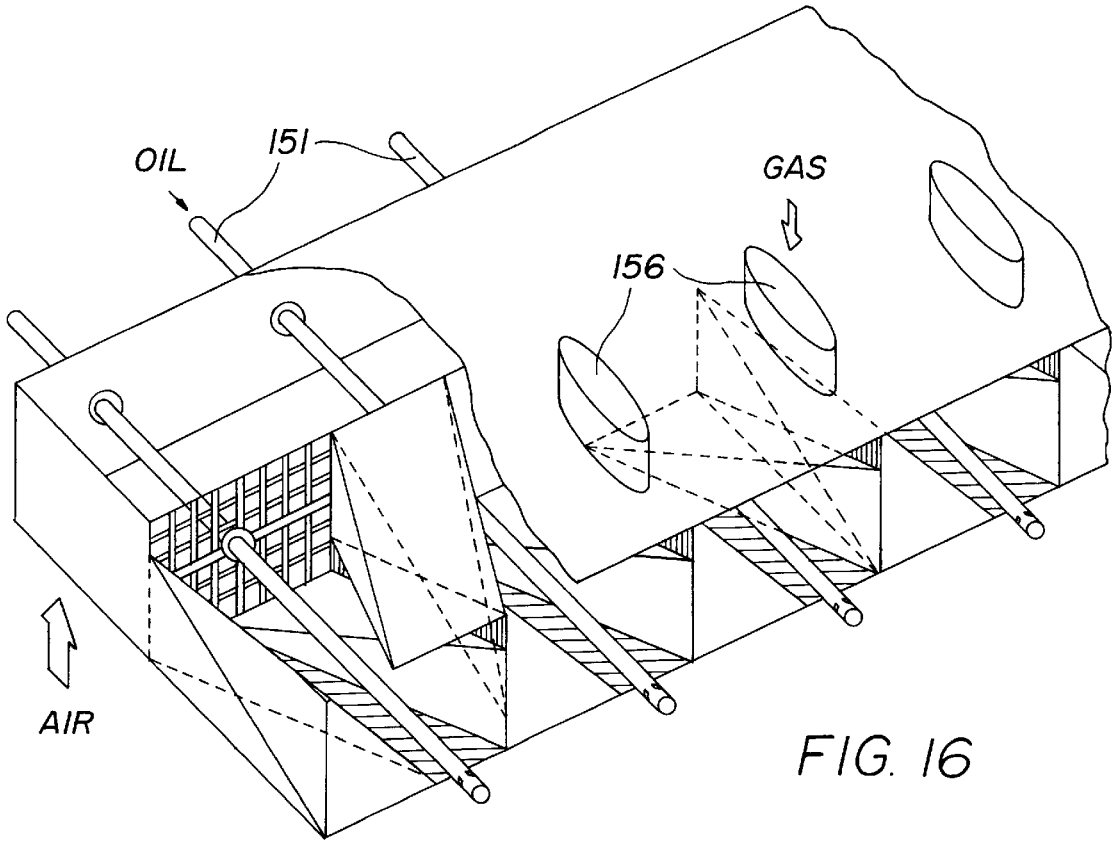
FIG. 16 shows a perspective partial view of the inlet of the secondary burners with fuel feed.
Figure 16A:
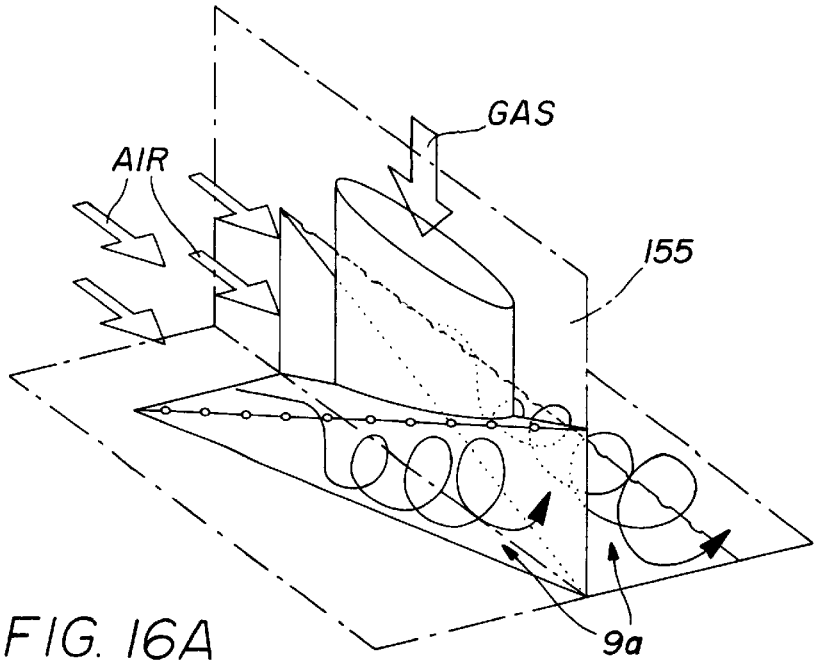
FIG. 16A shows the vortex formation at the inlet of the secondary burners.

FIG. 16 shows a perspective partial view of the inlet of the secondary burners, half vortex generators 9*a* according to FIG. 5 again being arranged in this first plane, although in a different arrangement to that at the secondary-burner outlet. One central fuel lance 151 each for oil as well as gas-feed connection pieces 156 leading to the vortex generators are provided for the individual burners. In FIG. 16A, which represents a detail view of FIG. 16, the vortex formation on either side of the radially running segment boundary wall 155 is shown; owing to the fact that the air first acts alternately on the edge 15 and the edge 16 of the half vortex generators arranged next to one another in the peripheral direction, an equidirectional overall vortex is obtained in the counterclockwise direction.

Concerning the mixing section

The vortex generators in the secondary burners may be designed in such a way that recirculation zones downstream are mostly avoided. The dwell time of the fuel particles in the hot zones is consequently very short, which has a favorable effect on minimum formation of $NO_x$. However, the vortex generators, as in the present case, may also be designed in such a way and staggered in depth in the duct 154 in such a way that a defined backflow zone 170 arises at the outlet of the secondary burners, which backflow zone 170 stabilizes the flame in an aerodynamic manner, i.e. without a mechanical flame retention baffle.

The mixture leaves the secondary burners 150 with a vortex motion and enters the flame from the precombustion chamber 61. In the process, the collision of the two vortex flows results in intimate mixing over the shortest distance and a renewed vortex breakdown, which leads to the backflow zone 170 already mentioned.

The intensive mixing produces a good temperature profile over the cross section through which flow occurs and in addition reduces the possibility of thermoacoustic instability. By their presence alone, the vortex generators act as a damping measure against thermoacoustic vibrations.

The partial-load operation of combustion chambers is simple to realize with the burners described by graduated fuel feed to the individual modules. If only the primary burners are operated with premix flame, the main flow of the secondary burners is utilized as diluent air. This highly turbulent main flow mixes very quickly at the outlet of the secondary burners with the hot gases issuing from the primary stage. A uniform temperature profile is therefore produced downstream. When the burner is being loaded, fuel is gradually injected into the secondary burners and intensively intermixed with the combustion air before ignition. These secondary burners thus always work in premix operation; they are ignited and stabilized from the primary burners.

The burner aerodynamics consist of two radially stepped vortex patterns. The radially outer vortices are dependent upon the number and geometry of the vortex generators 9. The radially inner vortex structure coming from the double-cone burner may be influenced by adaptation of certain geometric parameters at the double-cone burner. The quantity distribution between primary burner and secondary burners may be effected as desired by appropriate coordination of the areas through which flow occurs, in which case the pressure losses are to be taken into account. Because the vortex generators have a relatively small pressure loss, the flow through the secondary burners may take place at a higher velocity than the flow the primary burner. A higher velocity at the outlet of the secondary burners has a favorable effect with regard to flashback of the flame.

Figure 17:
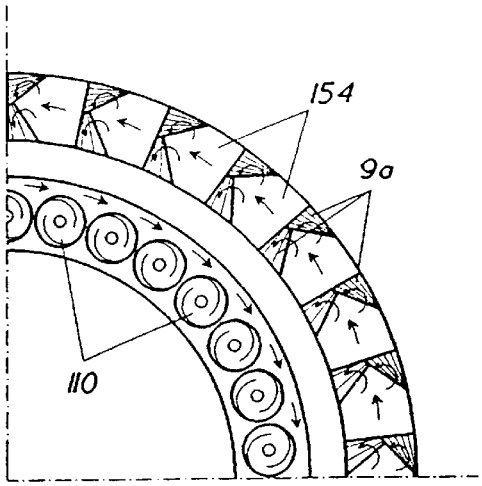
FIG. 17 shows an arrangement variant of vortex generators arranged next to one another.

In FIG. 17 an annular combustion chamber is proposed in which the radially stepped vortex patterns described above are exactly defined. The radially inner, large-scale vortex and the radially outer vortex have opposite directions of rotation. In order to achieve this, a number of vortex generators 9*a* according to FIG. 5 are grouped around the double-cone burner 110. These vortex generators 9*a* are so-called half vortex generators in which only one of the two side surfaces of the vortex generator 9*a* is provided with the sweepback angle $\alpha/2$. The other side surface is straight and orientated in the burner axis. In contrast to the symmetrical vortex generator, here a vortex is only produced at the swept-back side. Accordingly, there is no vortex-neutral field downstream of the vortex generator; on the contrary, a swirl is imposed on the flow. Once the vortex generators uniformly distributed in the peripheral direction all have the same orientation, a swirl equidirectional over the periphery, as indicated in FIG. 17, results from the originally swirl-free main flow downstream of the vortex generators.

Figure 18:
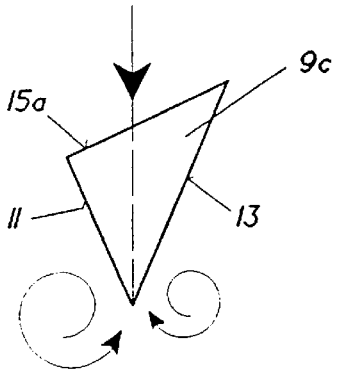
FIG. 18 shows a further embodiment variant of the vortex generator.
Figure 19:
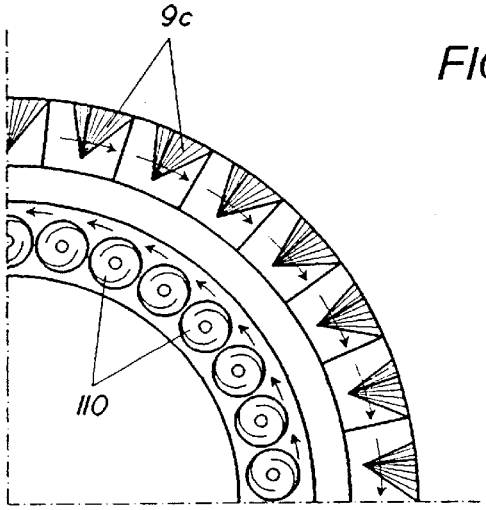
FIG. 19 shows an arrangement variant of vortex generators, arranged next to one another, according to FIG. 17.

FIGS. 18 and 19 show an embodiment variant of a vortex generator 9*c* in a plan view and its arrangement in an annular duct in a front view. The two side surfaces 11 and 13 enclosing the sweepback angle a have different lengths. This means that the top surface 10 bears with an edge 15*a* running at an angle to the duct through which flow occurs against the same duct wall as the side walls. The vortex generator then of course has a different setting angle $\theta$ over its width. A variant of this type has the effect that vortices of different intensity are produced. For example, influence may be brought to bear on a swirl adhering to the main flow. Alternatively, a swirl is imposed on the originally swirl-free main flow downstream of the vortex generators by the different vortices.

Configurations of this type are readily suitable as an independent, compact burner unit. If a plurality of such units are used, for example in an annular combustion chamber, the swirl imposed on the main flow may be utilized in order to improve the cross-ignition behavior of the burner configuration, e.g. during partial load.

Concerning the mode of operation

Figure 20:
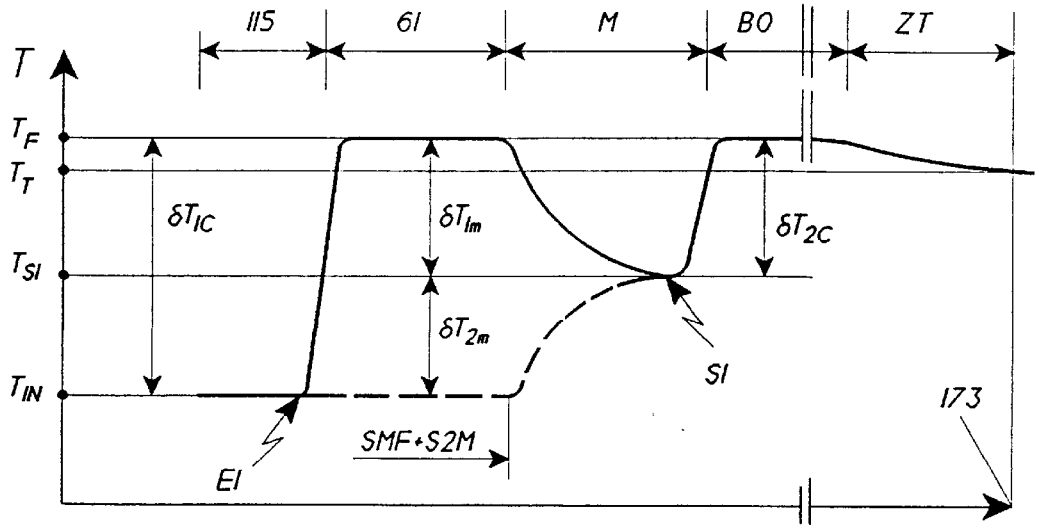
FIG. 20 shows a diagram of temperature along the extent of the combustion chamber.

FIG. 20 shows in a self-explanatory diagram how the temperatures develop along the longitudinal extent of the combustion chamber. The first row of turbine guide blades is designated therein by 173 (as in FIG. 1).

The following zones plotted above the diagram and likewise designated in FIG. 1 mean:

115 Premix section in the primary burner 110
61 Precombustion chamber
SMF First premix section and fuel injection in the secondary burner 150
S2M Second premix section in the secondary burner 150
M Mixing section
BO Burn-out zone in the secondary combustion chamber 62
ZT Transition zone at the turbine inlet 173
Furthermore
EI Location of external ignition at the primary burner
SI Location of self-ignition in the mixing section M
The following temperatures are plotted on the abscissa
$T_F$ Flame temperature
$T_T$ Turbine inlet temperature
$T_{SI}$ Self-ignition temperature
$T_{IN}$ Temperature of the fuel/air mixture
Furthermore
$\delta T_{1C}$ Temperature increase as a result of combustion
$\delta T_{1m}$ Temperature drop as a result of mixing
$\delta T_{2m}$ Temperature increase as a result of mixing
$\delta T_{2C}$ Temperature increase as a result of combustion The action of the novel measure is as follows: during the precombustion, nitrogen, as a result of being divided in two equal portions distributed to the primary burner and secondary burner, is only produced at half the total volumetric flow on account of the temperature increase $\delta T_{1C}$. This half volumetric flow only has a short dwell time in the precombustion chamber 61 until mixing with the mixture from the secondary burners, which has a favorable effect on the $NO_x$ production.

During the mixing of the hot flue gases from the precombustion chamber 61 with the fuel/air mixture from the secondary burners, the mixing temperature must not drop below the self-ignition temperature $T_{SI}$.

After the self-ignition, the temperature increase $\delta T_{2C}$ of the total volumetric flow is too small and the period up to complete burn-out in the zone BO is too short in order to produce $NO_x$ to a substantial degree.

From all this it can be recognized that, in the case of this lean/lean concept, the average volumetric flow is exposed to the high flame temperature only for a reduced time compared with conventional single-stage premix combustion.

Equivalent solutions

Figure 21:
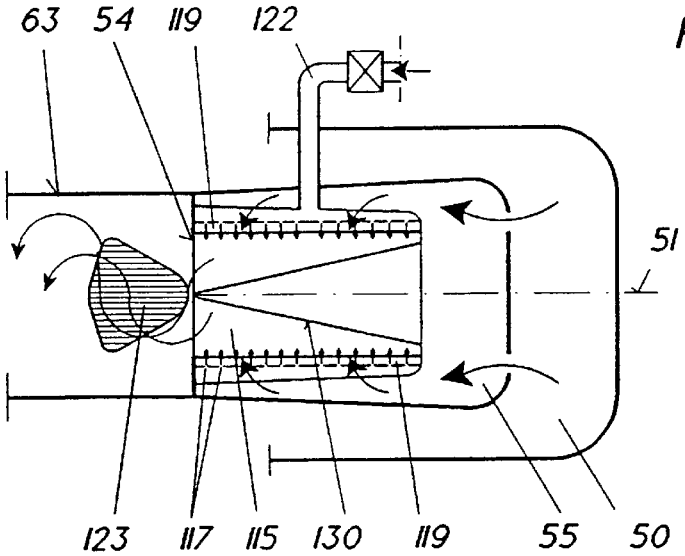
FIG. 21 shows an embodiment variant of the primary burner.

The invention is in principle not restricted to the use of primary burners of the double-cone type of construction shown. On the contrary, it may be used in all combustion-chamber zones in which flame stabilization is produced by a prevailing air velocity field. As a further example of this, reference is made to the burner shown in FIG. 21. In this FIG. 21, all functionally identical elements are provided with the same reference numerals as in the burner according to FIGS. 1–3B. This despite a different structure, which applies in particular to the tangential inflow gaps 119 running cylindrically here. The area of the premix space 115 through which flow occurs, which area increases in the direction of the burner outlet, is formed in this burner by a centrally arranged insert 130 in the form of a right circular cone, the cone tip being located in the region of the plane of the front plate. It will be understood that the generated surface of this cone may also be curved. This also applies to the progression of the sectional surfaces 111, 112 in the burners shown in FIGS. 1–3B.

Of course, in a deviation from the 2-stage combustion shown and described, more than two stages may also be used. The number of combustion stages and the nature of the fuel and air distribution over the plurality of stages is ultimately dependent upon the desired performance of the combustion chamber.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A combustion chamber with two-stage combustion, comprising:

at least one wall defining a first stage combustion chamber and a second stage combustion chamber;

at least one primary premixing burner having means for introducing combustion air into a burner premixing space in a tangential direction, and fuel injection nozzles to inject fuel into the combustion air, an outlet of the primary premixing burner connecting to the first combustion chamber, wherein the tangentially directed flow of combustion air into the premixing space produces a flame-stabilizing swirl in a flow exiting the outlet of the primary premixing burner; and at least one secondary burner which is disposed with an outlet downstream of the first stage combustion space, the secondary burner having means to introduce a premixture of fuel and combustion air into the second stage combustion chamber for auto-ignition of the premixture in the second stage combustion chamber.

2. The combustion chamber as claimed in claim 1, wherein the at least one primary premixing burner comprises two hollow, conical sectional bodies nested one inside the other to define a conical interior space widening in a direction of flow and whose respective center axes are mutually offset, adjacent walls of the two sectional bodies forming gaps for a tangentially-directed flow combustion air into the interior space, and having gas-inflow openings distributed in a longitudinal direction in the walls of the two sectional bodies to inject fuel in the tangential gaps.

3. The combustion chamber as claimed in claim 1, wherein said means for introducing a fuel and combustion air mixture into the secondary burner includes means for injecting at least one of a gaseous and liquid fuel as a secondary flow into a duct defined by the secondary burner for mixing into a gaseous main flow of combustion air, and further comprising a plurality of vortex generators arranged next to one another over a periphery of the duct.

4. The combustion chamber as claimed in claim 3, wherein at least one vortex generator of said plurality is formed as a body having three surfaces around which flow occurs freely and which extend in the direction of flow, one surface forming a top surface and a second and third surface forming side surfaces, wherein the side surfaces are mounted with one edge on a wall segment of the duct and are mutually oriented at a sweepback angle, wherein the top surface has an edge oriented transversely to a flow direction of the duct and contacting the wall segment on which the side surfaces are mounted, and wherein longitudinally directed edges of the top surface are joined with longitudinally directed edges of the side surfaces projecting into the flow duct, the top surface being oriented at a setting angle to the wall segment.

5. The combustion chamber as claimed in claim 4, wherein the two side surfaces are arranged symmetrically around a symmetry axis aligned with a flow direction of the duct.

6. The combustion chamber as claimed in claim 4, wherein a ratio of a height of the at least one vortex generator to a duct height is selected in such a way that a vortex produced fills at least one of a full duct height and a full height of a duct part allocated to the at least one vortex generator directly downstream of the at least one vortex generator.

7. The combustion chamber as claimed in claim 3, wherein said means for injecting a fuel as a secondary flow is a fuel lance arranged centrally in the duct, said fuel lance having means for at least one of longitudinal injection and cross-jet injection.

8. The combustion chamber as claimed in claim 3, wherein said plurality of vortex generators is mounted in the duct and arranged next to one another in two planes extending in a longitudinal direction of the secondary burner (150).

9. The combustion chamber as claimed in claim 1, wherein a longitudinal axis of the secondary burner forms an acute angle with a longitudinal axis of the first stage combustion chamber.

10. The combustion chamber as claimed in claim 1, wherein said at least one wall defines an annular first stage combustion chamber and annular second stage combustion chamber, and wherein a plurality of primary burners and secondary burners are provided in two rings, the secondary burners being located on a radially outer ring, wherein outlets of the primary premixing burners and outlets of the secondary burners are positioned at least approximately on a single plane.

11. The combustion chamber as claimed in claim 10, further comprising a plurality of vortex generating wedges adjacent an outlet of the precombustion chamber in a region where the secondary burners lead into the secondary combustion chamber, mounted on the the at least one wall.

12. The combustion chamber as claimed in claim 11, wherein at a transition between the first stage combustion chamber and the second stage combustion chamber the at least one wall is provided with a constriction opposite a point where the secondary burners lead into the second stage combustion chamber.

* * * * *